United States Patent [19]

Chandler

[11] Patent Number: 4,944,419

[45] Date of Patent: Jul. 31, 1990

[54] COMPARTMENTALIZED REFUSE CONTAINER

[76] Inventor: John W. Chandler, 131 NW. 55th St., Seattle, Wash. 98107

[21] Appl. No.: 349,325

[22] Filed: May 8, 1989

[51] Int. Cl.[5] ..... B65D 1/24; B65D 25/06

[52] U.S. Cl. ..... 220/1 T; 220/20; 220/20.5; 220/22

[58] Field of Search ..... 220/1 T, 20.5, 22.1

[56] References Cited

U.S. PATENT DOCUMENTS

| | | | |
|---|---|---|---|
| 508,325 | 11/1893 | Lewis | 220/20.5 |
| 814,563 | 3/1906 | Pond | 220/20.5 |
| 1,013,775 | 1/1912 | Hoffman | 220/1 T |
| 1,021,872 | 4/1912 | Kingsbury | 220/1 T |
| 1,037,625 | 9/1912 | Hofer | 220/20.5 |
| 1,226,634 | 5/1917 | Briese | 220/20.5 |
| 1,238,090 | 8/1917 | Beringer | 220/20.5 |
| 1,239,427 | 9/1917 | Bunnell et al. | 220/20.5 |
| 1,239,881 | 9/1917 | Cawby | 220/20.5 |
| 1,251,870 | 1/1918 | Denzer | 220/20.5 |
| 1,286,368 | 12/1918 | Lucas | 220/20.5 |
| 2,559,699 | 7/1951 | Bard et al. | 220/22.1 |
| 2,582,207 | 1/1952 | Shaw | 220/20.5 |
| 2,905,354 | 9/1959 | Ericson | 220/20.5 |
| 3,622,032 | 11/1971 | Tilche | 220/20.5 |
| 3,628,655 | 12/1971 | Bohannon | 220/22.1 |
| 3,720,346 | 3/1973 | Cypher | 220/1 T |
| 4,739,894 | 4/1988 | Pender | 220/1 T |
| 4,848,570 | 7/1989 | Gosciniak | 220/20.5 |

FOREIGN PATENT DOCUMENTS

| | | | |
|---|---|---|---|
| 2546772 | 4/1977 | Fed. Rep. of Germany | 220/1 T |
| 3625995 | 11/1988 | Fed. Rep. of Germany | 220/1 T |

*Primary Examiner*—Stephen Marcus
*Assistant Examiner*—Stephen Castellano
*Attorney, Agent, or Firm*—Christopher Duffy

[57] ABSTRACT

In addition to a top opening, the container has at least one pair of apertures in a side wall thereof, through one of which a divider panel is removably inserted to form a false bottom for the relatively top portion of the container. The other aperture serves as an entry port for loading one type of refuse in the relatively bottom portion of the container. The top portion is loaded with a second type, meanwhile, through the top opening; and when the container is to be emptied, the integrity of each type is preserved by unloading the top portion first and then removing the panel to expose the bottom portion of the container to the top opening.

12 Claims, 2 Drawing Sheets

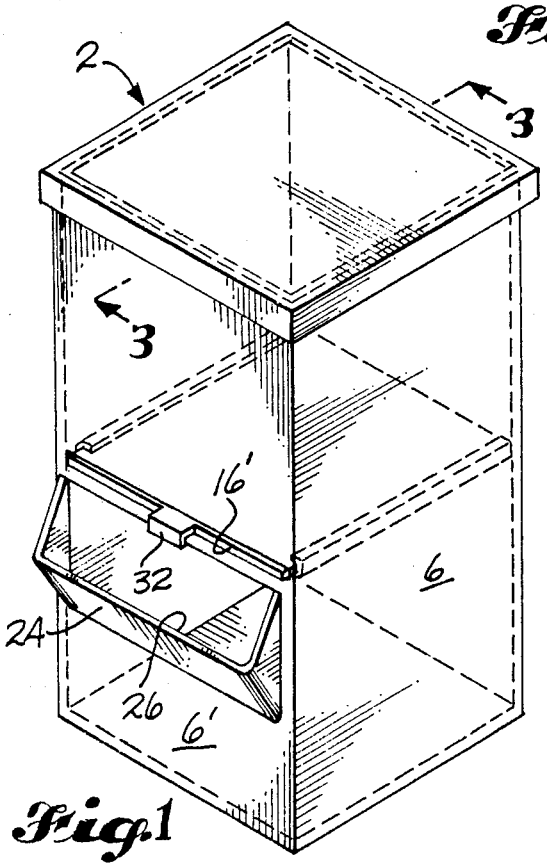
Fig.1
Fig.3
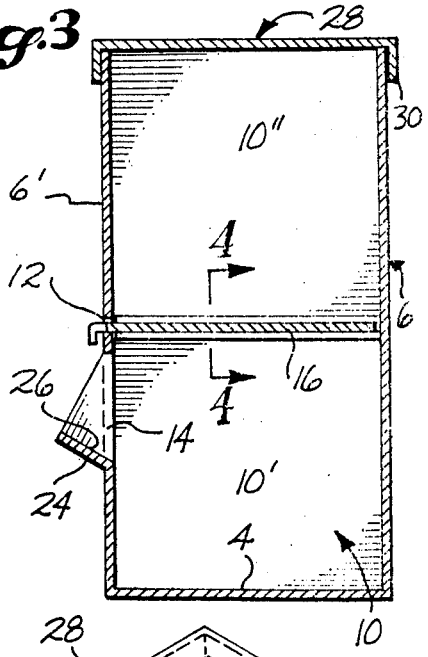
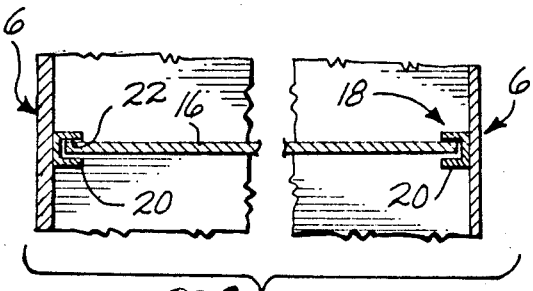
Fig.4
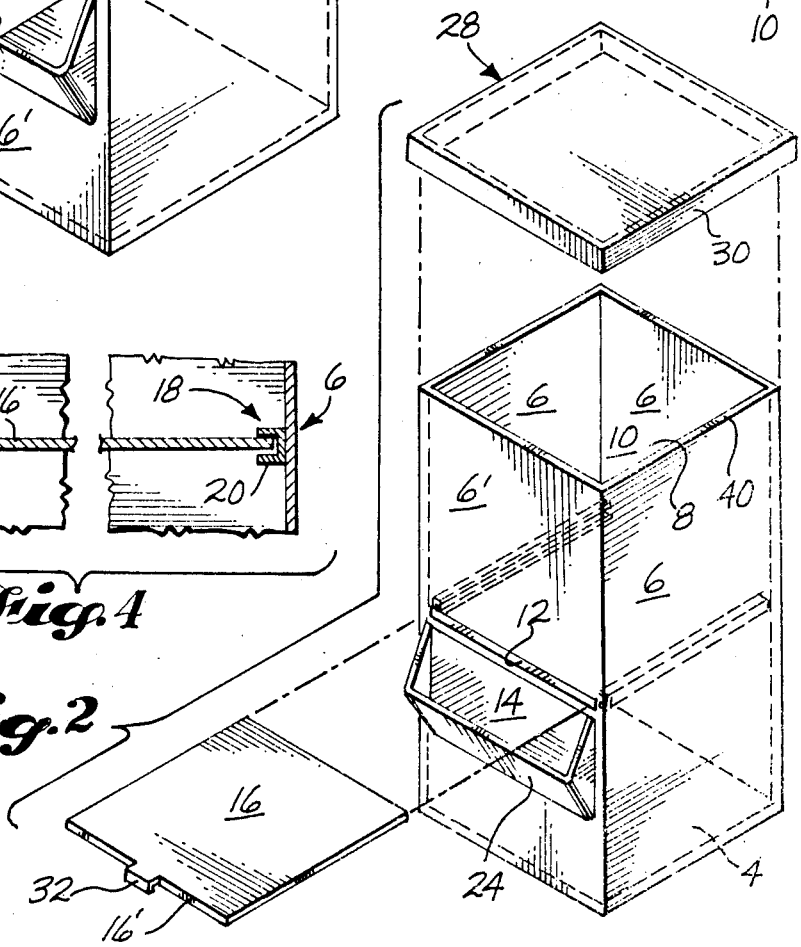
Fig.2

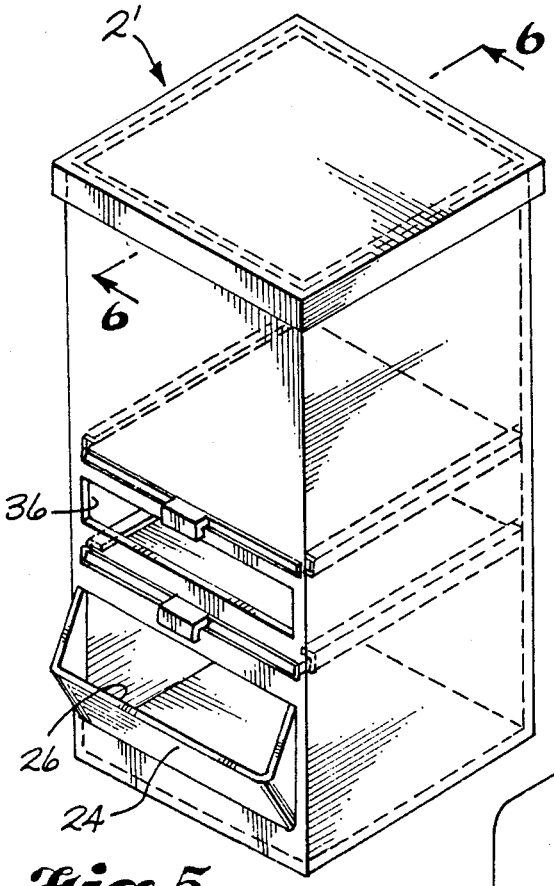
Fig. 5
Fig. 6
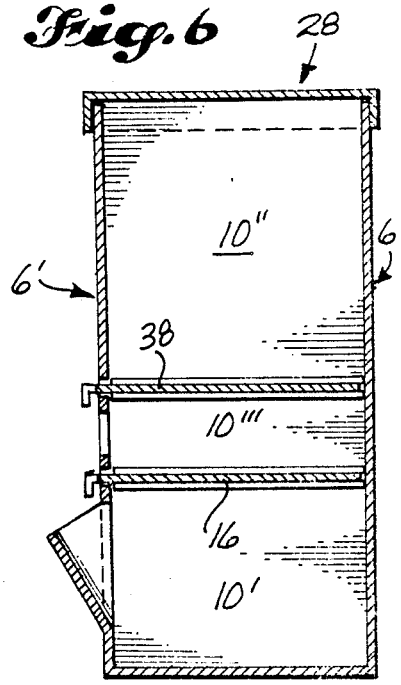
Fig. 7
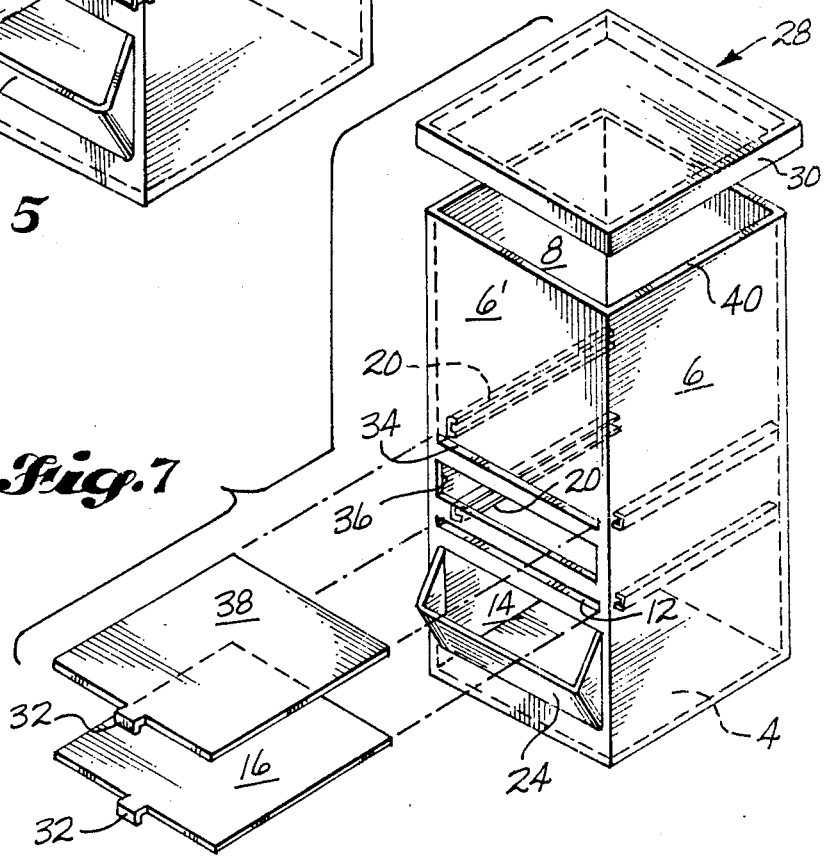

COMPARTMENTALIZED REFUSE CONTAINER

TECHNICAL FIELD

This invention relates to a container for refuse or the like, and especially household refuse. In particular, the invention relates to a refuse container wherein two or more types of refuse can be segregated from one another in the container, and then separately unloaded from the container when the container is emptied. The invention is especially useful in segregating recyclable and non-recyclable refuse from one another, and if desired, segregating two or more types of recyclable refuse from one another at the same time as the recyclable is segregated from the non-recyclable.

BACKGROUND ART

Compartmentalized refuse containers are known, but they do not enable the user to segregate two or more types of refuse in the container, and then subsequently preserve the segregation as he unloads the refuse from the container. For example, see U.S. Pat. No. 1,226,634 to Briese wherein a divider panel is employed to divide the interior of the container into two compartments, but wherein no provision is made for separately loading and unloading the compartments for the purposes mentioned. In U.S. Pat. No. 992,006, U.S. Pat. No. 4,739,849, U.S. Pat. No. 3,856,173 and U.S. Pat. No. 3,720,346, compartmentalized containers are also shown, but again no provision is made for separately loading and unloading the compartments for the purposes mentioned.

DISCLOSURE OF THE INVENTION

According to the invention, an elongated upright container is provided for holding refuse and the like, and the container has a closed bottom, a sidewall structure including a set of side walls upstanding about the bottom, and a top opening defined by the upper edges of the side walls. The container is adapted to be loaded and unloaded through the top opening by a person standing to the sides of the container, and the side walls of the container define a hollow bin for the refuse between the closed bottom and top opening of the container. The bin has a pair of apertures therein which open through the sidewall structure to the outside of the container at levels below the top opening thereof. A divider panel is provided for forming a false bottom in the container, and one of the apertures is rectangular and disposed at an intermediate level between the top opening and bottom of the container, to form a horizontally extending slot for the divider panel. The divider panel is removably insertable in the bin through the slot, and the container has means disposed about the bin at the level of the slot to support the panel crosswise of the bin at said level. Meanwhile, the other of the apertures is disposed at a level relatively below the slot, and adapted to form an entry port for loading refuse in the portion of the bin below the slot. In consequence, when given two types of refuse, the two types can be loaded in the relatively top and bottom portions of the bin, above and below the slot, segregated from one another by the panel, and then the relatively top and bottom portions of the bin can be separately unloaded through the top opening of the container to preserve the integrity of the respective types of refuse, by unloading the relatively top portion through the top opening and then removing the panel through the slot to open the relatively bottom portion of the bin to the top opening of the container.

In certain of the presently preferred embodiments of the invention, the container has a quadrilateral outline at the side walls thereof. The support means for the panel include a pair of cleats on the walls of the bin at the level of the slot, and the cleats form ledges on which the panel rests when inserted in the bin. Preferably, the cleats are opposed to one another across the bin and have grooves therein which are coplanar with the slot. The panel is slideably engageably in the slot, and in the grooves, when inserted in the bin through the slot. In addition, the container has a lip projecting outwardly from the wall of the container at the one side thereof, and below the port, to form a chute for receiving the refuse to be loaded through the port for the relatively bottom portion of the bin.

Preferably, the container is also equipped with a lid for forming a cover over the bin at the top opening of the container, and the lid is preferably adapted to mate with the container about the top opening thereof, such as through the use of a depending skirt about the perimeter of the lid.

Additionally, the operatively trailing edge of the panel preferably has a handle projecting thereform for ease in removing the panel from the bin through the slot.

In some embodiments of the invention, the container has an additional pair of apertures in the sidewall structure thereof, one of which additional apertures is rectangular to form a second horizontally extending panel-accomodating slot therein at a second level spaced above the aforementioned level of the first mentioned slot. The other of the additional apertures is disposed in the space between the first and second mentioned slots, to form a second entry port for loading refuse in the relatively bottom section of the relatively top portion of the bin. A second divider panel is removably insertable in the second slot, and means are disposed about the bin at the level of the second slot to support the second panel crosswise of the bin. In this way, the bin is effectively divided into three relatively stacked compartments when the respective panels are inserted in the bin. This in turn enables the refuse to be segregated in three separate portions, such as where three different types of refuse are loaded into the container.

BRIEF DESCRIPTION OF THE DRAWINGS

These features will be better understood by reference to the accompanying drawings which illustrate two of the presently preferred embodiments of the invention.

In the drawings:

FIG. 1 is a perspective view of a lidded container compartmentalized with a divider panel for the segregation of two types of refuse therein;

FIG. 2 is an exploded view of the container, illustrating the manner in which the divider panel and lid are removed therefrom;

FIG. 3 is a vertical cross-sectional view of the container along the line 3—3 of FIG. 1;

FIG. 4 is a part cross-sectional view of the container along the line 4—4 of FIG. 3;

FIG. 5 is a perspective view of a lidded container compartmentalized with two divider panels for the segregation of three types of refuse therein;

FIG. 6 is a vertical cross-sectional view of the same along the line 6—6 of FIG. 5; and FIG. 7 is an exploded view of the latter container, illustrating the manner in which the pair of divider panels and lid are removed therefrom.

BEST MODE FOR CARRYING OUT THE INVENTION

Referring to the drawings, it will be seen that each container 2 or 2' has a closed bottom 4, a set of side walls 6 upstanding about the bottom, and an opening 8 within the set of walls at the top thereof. The container is adapted to be loaded and unloaded through the top opening 8 by a person standing at one side 6' of the container, and the side walls 6 of the container define a hollow bin 10 between the closed bottom 4 and top opening 8 thereof, for the refuse and the like (not shown) which is to be loaded and unloaded in and from the same. However, the side walls 6 of the container also have a pair of apertures 12 and 14 therein at the one side 6' of the container, and a divider panel 16 is provided for forming a false bottom in the container, with which to segregate different types of refuse. One of the apertures, 12, is horizontally rectangular and disposed at an intermediate level between the top opening 8 and bottom 4 of the container, to form a slot for the divider panel 16. The divider panel 16 is removeably insertable in the bin 10 through the slot 12, and the container has means 18 disposed about the bin at the level of the slot to support the panel crosswise of the bin at said level. Meanwhile, the other of the apertures, 14, is disposed below the slot 12 and adapted to form an entry port for loading refuse in that portion 10' of the bin below the slot. In this way, two different types of refuse can be loaded in the relatively top and bottom portions 10'' and 10' of the bin, above and below the slot 12, segregated from one another by the panel 16, and then the relatively top and bottom portions 10'' and 10' of the bin can be separately unloaded through the top opening 8 of the container, to preserve the integrity of the respective types of refuse, by unloading the relatively top portion 10'' through the top opening and then removing the panel through the slot to open the relatively bottom portion 10' of the bin to the top opening 8 of the container.

More specifically, the container 2 or 2' is square or rectangularly cross-sectioned to have a quadrilateral outline at the side walls 6 thereof, and the support means 18 for the panel 16 include a pair of cleats 20 on the walls of the bin 10 at the level of the slot 12. The cleats 20 form ledges on which the panel rests when inserted in the bin, and commonly, the cleats 20 are opposed to one another across the bin and have grooves 22 therein which are coplanar with the slot. The panel, meanwhile, is slideably engageable in the slot, and in the grooves 22, so as to be more tightly securable in the bin when inserted through the slot.

In addition, the container 2, or 2' preferably has a lip 24 projecting outwardly from the wall of the container at the one side 6' thereof, and below the port 14, to form a chute 26 for receiving the refuse to be loaded through the port for the relatively bottom portion 10' of the bin.

Preferably, the container 2 or 2' is also equipped with a lid 28 for forming a cover over the bin 10 at the top opening 8 of the container, and the lid 28 is preferably adapted to mate with the container about the top opening thereof, such as through the use of a depending skirt 30 about the perimeter of the lid.

Additionally, the operatively trailing edge 16' of the panel 16 preferably has a handle 32 projecting therefrom, for use in removing the panel from the bin 10 through the slot 12.

In FIGS. 1–4, the container 2 has a single pair of apertures 12,14 in the wall at the one side 6' thereof. In FIGS. 5–7, the container has an additional pair of apertures 34 and 36 in the wall at the one side 6' thereof. One of the additional pair, 34, is rectangular to form a second horizontally extending panel-accomodating slot at a second level spaced above the aforementioned level of the first mentioned slot 12. The other of the additional apertures, 36, is disposed in the space between the first and second mentioned slots 12 and 34, to form a second entry port for loading refuse in the relatively bottom section 10''' of the relatively top portion 10'' of the bin. A second divider panel 38 is removably insertable in the second slot 34, and again, there are means 18 disposed about the bin at the level of the second slot to support the second panel crosswise of the bin. Given the two sets of apertures 12,14 and 34,36 and the pair of panels 16,38, the bin 10 is effectively divided into three relatively stacked compartments 10', 10'', 10''' when the respective panels are inserted in the bin. This in turn, enables the refuse to be segregated in three separate portions, such as where three different types of refuse are loaded into the container.

To illustrate, non-newspaper recyclable paper may be loaded in the bottom section 10'''' of the relatively top portion 10'' of the bin, and plastic, glass and metal cans, bottles and the like, may be loaded in the relatively bottom portion 10' of the bin. The remainder of the relatively top portion 10'' of the bin is then reserved for non-recyclable trash. This could be captured within a paper or plastic bag (not shown) removably suspended in the top portion from the rim 40 of the container, or it could be collected on top of the panel 38 which, as indicated, functions as a false bottom for the remainder of the top portion.

The lid 28 may be hinged or otherwise pivotally mounted on the rim portion 40 of the container to be opened and closed by means of a foot pedal (not shown) in conventional fashion.

I claim:

1. In combination, an elongated upright container for holding refuse and the like, said container having a closed bottom, a sidewall structure including a set of side walls upstanding about the bottom, and a top opening defined by the upper edges of the side walls, said container being adapted to be loaded and unloaded through said top opening by a person standing to the sides of the container, said side walls of the container defining a hollow bin for the refuse between the closed bottom and top opening of the container, and said bin having a pair of apertures therein which open through the sidewall structure to the outside of the container at levels below the top opening thereof, a divider panel for forming a false bottom in the container, one of said apertures being rectangular and disposed at an intermediate level between the top opening and bottom of the container, to form a horizontally extending slot for the divider panel, said divider panel being removably insertable in the bin through the slot and said container having means disposed about the bin at the level of the slot to support the panel crosswise of the bin at said level, the other of said apertures being disposed at a level relatively below the slot and adapted to form an entry port for loading refuse in the portion of the bin below the slot, whereby two types of refuse can be loaded in the relatively top and bottom portions of the bin, above and below the slot, segregated from one another by the panel, and then the relatively top and bottom portions of the bin can be separately unloaded through the top opening of the container, to preserve the integrity of the respective types of refuse, by unloading the relatively top portion of the bin through the top opening, and then removing the panel through the slot to open the relatively bottom portion of the bin to the top opening of the container.

2. The combination according to claim 1 wherein the container has a quadrilateral outline at the side walls.

3. The combination according to claim 1 wherein the panel support means include a pair of cleats on the walls of the bin at the level of the slot, forming ledges on which the panel rests when inserted in the bin.

4. The combination according to claim 3 wherein the cleats are opposed to one another across the bin and have grooves therein which are co-planar with the slot, and wherein the panel is slideably engageable in the slot, and the grooves, when inserted into the bin through the slot.

5. The combination according to claim 1 wherein the container has a lip projecting outwardly from the wall of the container at the one side thereof, and below the port, to form a chute for receiving the refuse to be loaded through the port for the relatively bottom portion of the bin.

6. The combination according to claim 1 further comprising a lid for forming a cover over the bin at the top opening of the container, said lid being adapted to mate with the container about the top opening thereof.

7. The combination according to claim 1 further comprising a handle projecting from the operatively trailing edge of the panel for ease in removing the panel from the bin through the slot.

8. The combination according to claim 1 wherein the side walls of the container have an additional pair of apertures therein, one of said additional apertures being rectangular to form a second horizontally extending panel-accomodating slot therein at a second level spaced above the aforementioned level of the first mentioned slot and the other of said additional apertures being disposed in the space between the first and second mentioned slots to form a second entry port for loading refuse in the relatively bottom section of the relatively top portion of the bin, there being a second divider panel for removeable insertion in the second slot, and means disposed about the bin at the level of the second slot to support the second panel crosswise of the bin for division of the bin into three relatively stacked compartments when the respective panels are inserted therein.

9. The combination according to claim 1 wherein the container has vertical side walls.

10. The combination according to claim 1 wherein the side walls of the container are continuous and uninterrupted from the top opening to the bottom thereof.

11. The combination according to claim 1 wherein the divider panel is detachable from the container following the removal thereof from the slot.

12. The combination according to claim 1 wherein the pair of apertures are disposed on a common side of the container.

* * * * *